US007012410B2

(12) United States Patent
Bodano et al.

(10) Patent No.: US 7,012,410 B2
(45) Date of Patent: Mar. 14, 2006

(54) REGULATING SYSTEM

(75) Inventors: Emanuele Bodano, Padua (IT); Giorgio Chiozzi, Padua (IT); Andrea Logiudice, Sant' osvaldo (IT); Salvatore Piccolella, Padua (IT)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/948,112

(22) Filed: Sep. 23, 2004

(65) Prior Publication Data

US 2005/0099169 A1 May 12, 2005

(30) Foreign Application Priority Data

Sep. 30, 2003 (EP) ..... 03022149

(51) Int. Cl.
*G05F 1/618* (2006.01)

(52) U.S. Cl. ..... 323/274; 323/275; 323/280

(58) Field of Classification Search ..... 323/272, 323/273, 274, 275, 280, 281
See application file for complete search history.

(56) References Cited

U.S. PATENT DOCUMENTS

| | | | | |
|---|---|---|---|---|
| 4,680,483 | A * | 7/1987 | Giordano | 327/66 |
| 4,906,913 | A | 3/1990 | Stanojevic | |
| 5,036,269 | A * | 7/1991 | Murari et al. | 323/266 |
| 5,334,928 | A * | 8/1994 | Dobkin et al. | 323/280 |
| 5,828,206 | A * | 10/1998 | Hosono et al. | 323/273 |
| 6,150,801 | A | 11/2000 | Schwertlein et al. | |
| 6,204,646 | B1 * | 3/2001 | Hiramatsu et al. | 323/273 |
| 6,686,728 | B1 * | 2/2004 | Nakajima | 323/281 |
| 6,798,179 | B1 * | 9/2004 | Nakajima | 323/277 |

FOREIGN PATENT DOCUMENTS

EP 0 990 199 B1 11/2001

* cited by examiner

*Primary Examiner*—Bao Q. Vu
(74) *Attorney, Agent, or Firm*—Maginot Moore & Beck

(57) ABSTRACT

A regulating system comprises an input terminal for applying an input voltage, and an output terminal for providing an output voltage. A semiconductor element is connected between the input terminal and the output terminal and is operable to regulate the output voltage. A regulating signal generation circuit generates the regulating signal and comprises a current mirror arrangement including a first and second current mirror path, wherein a controlled current source is connected in series to the first current mirror path. The controlled current source induces a first current dependent on one of the output signals in the first current mirror path. A second current through the second current mirror path is dependent on the first current. A splitter circuit conducts the second current to the output terminal or to a reference potential, dependent on a load path voltage applied over the load path of the semiconductor element.

20 Claims, 4 Drawing Sheets

REGULATING SYSTEM

BACKGROUND

The invention relates to a regulating system. In particular, this invention relates to an electrical regulating system including a splitter circuit.

An example of a regulating system of this type designed as a voltage regulator is described in EP 0 990 199 B1 and is briefly explained based on FIG. 1 to aid in understanding the following invention.

The voltage regulator includes an input terminal K10 for application of an input voltage Vin10 against a reference potential GND10, and an output terminal K20 for providing a regulated output voltage Vout dependent on a reference voltage Vref in order to supply load Z10.

Functioning as the actuating element of the regulating system is a bipolar transistor Q10, the collector-emitter path of which is connected between the input and output terminals K10, K20. The regulating signal is the base current Ib10 of the bipolar transistor, which current is provided by a current mirror arrangement which has a first and second current mirror path.

The first current mirror path includes a current mirror transistor Q20, connected as a diode, followed by a controlled current source in the form of a bipolar transistor Q40, which current source induces a current through a first current path which is dependent on reference signal Vref and on a voltage measurement signal, in turn dependent on the output voltage Vout, which signal is provided by a voltage divided R10, R20. For this purpose, the base of this bipolar transistor Q40 is driven by a comparison signal which provides a comparator 10 from reference signal Vref and the voltage measurement signal.

The second current mirror path includes a second current mirror transistor Q30, the base of which is connected to the base of the first current mirror transistor Q20, and the collector-emitter path of which forms the second current mirror path. This second current mirror path is connected to output terminal K20 through a diode.

In this regulating system, if the voltage Vec10 over the load path of the regulating transistor Q10 is below a predefined value Vth, produced by:

$$Vth = Vbe10 + Vcesat30 + Vd10 \quad (1),$$

where Vbe10 is the base emitter voltage of the regulating transistor Q10, Vcesat30 is the saturation voltage of the second current mirror transistor Q30, and Vd10 is the conducting-state voltage of diode D1, then diode D1 is in the blocking state, and the regulating current Ib10 of the regulating transistor is supplied exclusively by the current source transistor Q40, then the applicable equation is:

$$Ic40 = Ib10 = Iout/\beta 10 \quad (2),$$

where Ic40 is the load current of current source transistor Q40, Iout10 is the load current flowing to the output terminal, and β10 is the current gain of regulating transistor Q10.

If the load path voltage Vec10 of regulating transistor Q10 exceeds the threshold value Vth according to (1), then diode D10 is conductive so that both current mirror paths contribute to regulating current Ib10. Based on the current mirror relationship set via the emitter surfaces of the two current mirror transistors, the applicable equation for current Ic40 through current mirror transistor Q40 is:

$$Ic40 = 1/(M+1) \cdot Ib10 = Iout10/(\beta 10 \cdot (M+1)) \quad (3).$$

The analogous applicable equation for current Ic30 along the second current mirror path, which based on the current mirror relationship is proportional to current Ic40, is:

$$Ic30 = M/(M+1) \cdot Ib10 \quad (4)$$

With diode D10 conductive, regulating transistor Q10 and second current mirror transistor Q30 form a Darlington configuration, as a result of which the power loss for load path voltages Vec10 greater than Vth is significantly reduced, since only a small component of the regulating current remains unutilized, whereas a larger component (for M>1) is fed through diode D10 to output terminal K20.

A problematic aspect here is that when diode D10 is in the blocking state, the load current of current source transistor Q40 must increase by the factor M+1 relative to the conducting state of the diode in order to provide the required base current needed to drive regulating transistor Q10—which is equivalent to saying that the driving voltage Vb40 of this transistor, given by the equation $$Vb40 = Vb40 + Ic40 \cdot R40 \quad (5),$$

must also increase by the factor M+1. R40 in (5) denotes the resistance value of the resistance following transistor Q40.

Frequently, however, this driving voltage is restricted by a protective circuit or by a supply voltage provided to driving circuit 10 with the risk that, given a small voltage drop, the regulator is not able to provide the full output current over the regulating transistor. Furthermore, problems due to a high substrate current may occur, if transistor Q40 is operated in his saturation region for high currents Ic40.

The goal of the invention is to provide a regulating system of the type referred to at the outset which, even in the event of a small voltage drop over the semiconductor element connected between the input and output terminals is able to provide the required output voltage, and which has a reduced power loss in the event of larger voltage drops.

SUMMARY

The regulating system according to the invention includes an input terminal to apply an input voltage, an output terminal to provide an output voltage and output current, as well as a semiconductor element having a load path which is connected between the input terminal and the output terminal, and having a control input to which a regulating signal is applied. The regulating system also includes a regulating signal generation circuit to generate the regulating signal, wherein this regulating signal generation circuit has a current mirror arrangement with a first and second current mirror path, wherein a controlled current source is connected in series to the first current mirror path, which current source induces a first current in the first current mirror path dependent on one of the output signals, and wherein a second current is dependent through the second current mirror path on the first current. In addition, a splitter circuit or switch circuit is provided which, depending on a load path voltage applied through the load path of the semiconductor element through the second current mirror path, conducts the second current through the second current mirror path to the output terminal or to a reference potential.

In the regulating system, the regulating signal which is the base current of the bipolar transistor when a bipolar transistor is used, is always generated by two current mirror paths, the current being conducted through the second current mirror path to the output terminal when the voltage over the load path of the semiconductor element connected between the input and output terminals is above a threshold value. Given a voltage below this threshold value, the current is conducted through the second current mirror path to the reference potential. Since in this regulating system some of the regulating signal is always provided by the second current mirror path, interrupting the connection between the second current mirror path and the output terminal does not result—as is the case in prior-art regulating systems—in an increase in the current demand for the controlled current source in the first current path, which current source adjusts the regulating signal dependent on one of the output signals.

The regulating system may be employed as a voltage regulator in which the output signal fed back to the controlled current source is either the output voltage or a signal dependent on the output voltage. However, the regulating system may also be employed as a current regulator, in which case the signal fed back to the controlled current source is a signal dependent on the output current. The situation in both cases is that when the output signal, i.e., the output signal or the output voltage, rises above a certain reference value, the semiconductor connected between the input and output terminals is deactivated, whereas when the output signal falls below a certain threshold value it is activated again.

In one embodiment, the splitter circuit which conducts the current through the second current mirror branch either to the output terminal or to the reference terminal, depending on the load path voltage applied over the load path of the semiconductor element, includes at least one rectifier element, in particular, a diode, having a load path which is connected between the second current mirror branch of the current mirror arrangement and the output terminal. In addition, at least one switching device is present including a semiconductor element which is connected between the second current mirror path and the reference potential, and which is designed to conduct the current to the reference potential when the rectifier element is in the blocking state.

This at least one semiconductor switching element is preferably a transistor, the load path of which is connected between the second current mirror branch and the reference potential, and the driving terminal of which is coupled to the first current mirror branch.

In another embodiment, the switching device includes a first and second transistor in a Darlington circuit, the load paths of which are each connected between the second current mirror branch and the reference potential, wherein the driving terminal of the first transistor is coupled to the first current mirror branch, while the driving terminal of the second transistor is coupled to a load path terminal of the first current mirror transistor.

In another embodiment, the switching device has a current measurement arrangement to measure a current through the rectifier element and to provide a current measurement signal. This current measurement signal is fed to a driving circuit for the at least one semiconductor element of the switching device in order to drive this at least one semiconductor element in a current-dependent manner through the rectifier element.

In one embodiment, the regulating signal generation circuit includes a differential amplifier to which a signal dependent on the output signal and a reference signal are fed, and which supplies a differential signal. This differential signal is fed to the controlled current source as an adjusting signal.

The controlled current source is preferably a bipolar transistor, to the base of which this differential signal is fed.

BRIEF DESCRIPTION OF THE DRAWINGS

The following discussion explains the invention in more detailed based on the figures.

Unless otherwise indicated, components with the same denotation are equivalent.

DESCRIPTION

Figure 1:
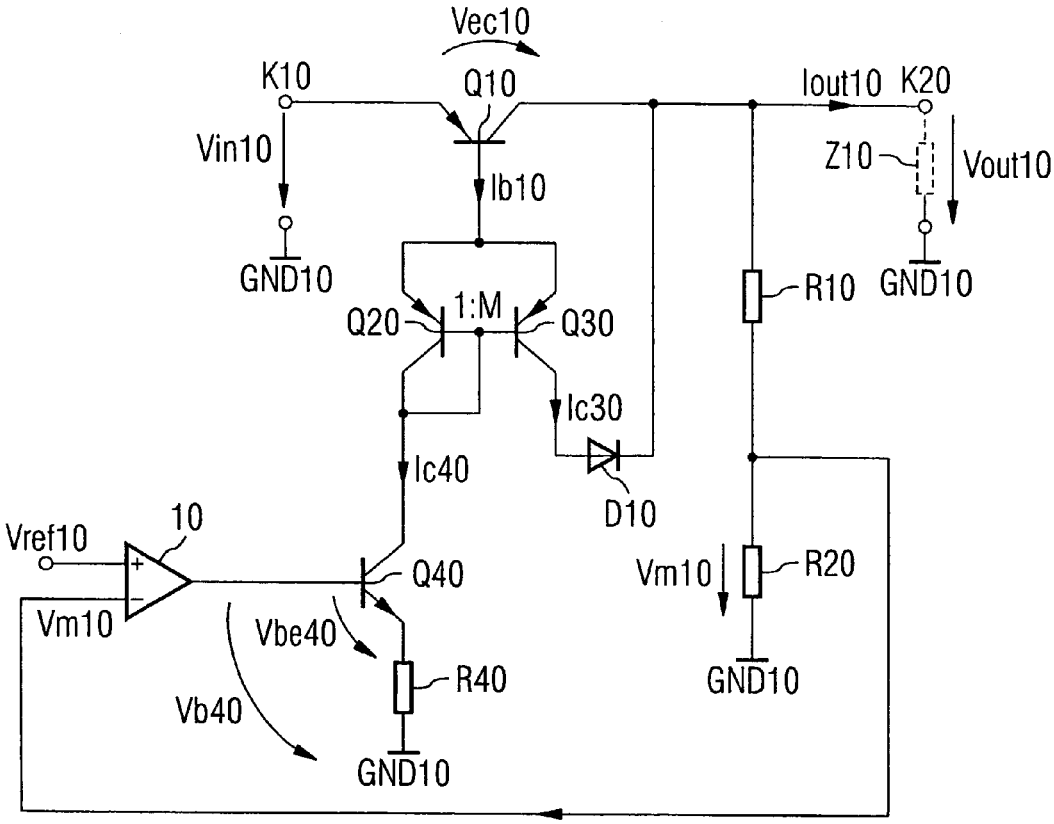
FIG 1 Prior Art
FIG. 1 shows a regulating system according to the prior art.
Figure 2:
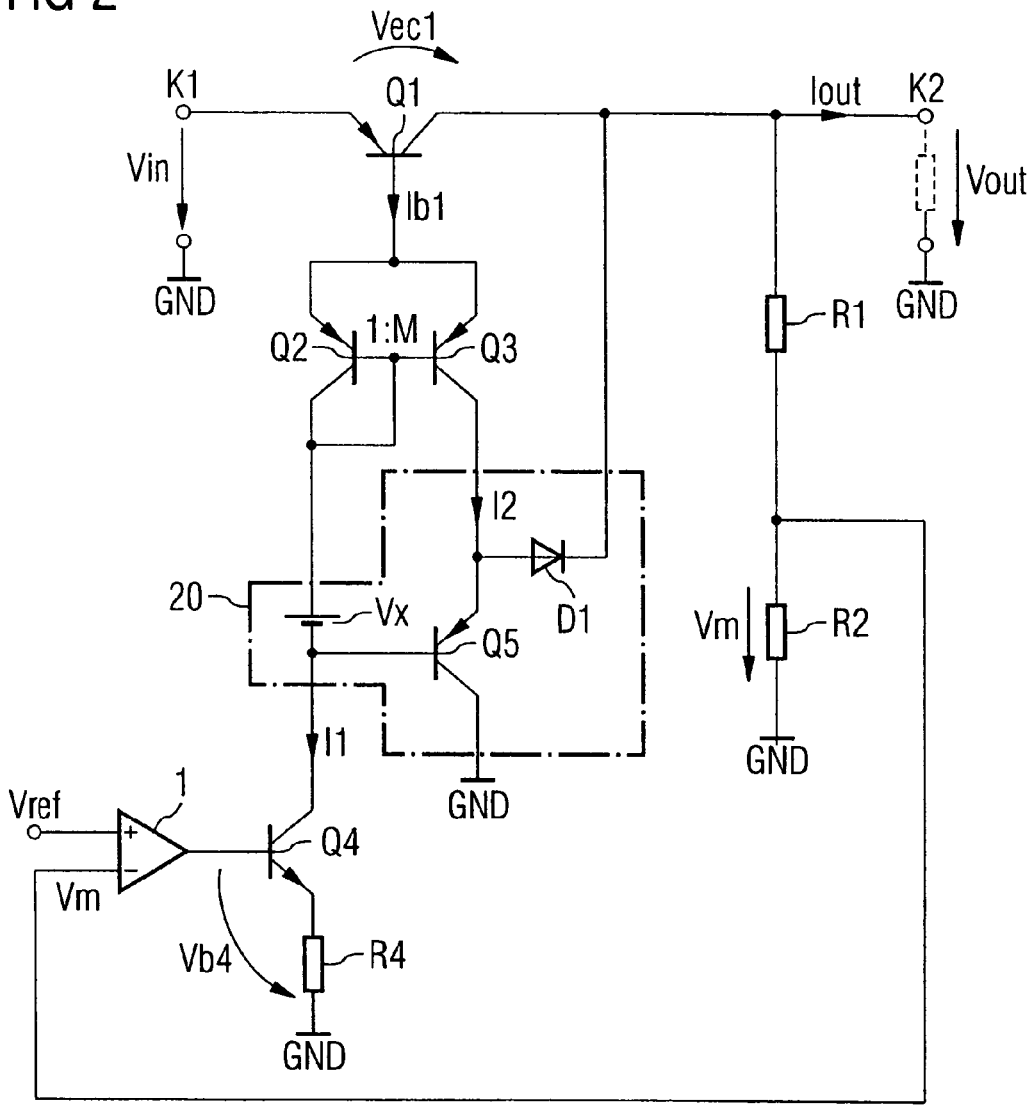
FIG. 2 shows a first embodiment of a regulating system according to the invention.

FIG. 2 shows a first embodiment of a regulating system according to the invention in the form of a voltage regulator.

The regulating system includes an input terminal K1 to apply an input voltage Vin to reference potential GND, and an output terminal K2 to provide both an output voltage Vout to reference potential GND and an output voltage Iout. A load Z supplied by this output voltage Vout and this output current Iout is shown by a broken line in FIG. 2.

The regulating system includes a regulating transistor Q1, which in this embodiment is in the form of a pnp bipolar transistor, the load path or collector-emitter path of which is connected between input terminal K1 and output terminal K2.

The regulating response of this system, i.e., the voltage drop Vec1 over the load path of regulating transistor Q1 to adjust output voltage Vout is provided by base current Ib1 of regulating transistor Q1.

The regulating signal Ib1 is provided by a current mirror arrangement which has a first current mirror path and a second current mirror path. The first current mirror path includes a first current mirror transistor Q2 interconnected as a diode, and a bias source Vx, the function of which will be explained below. A controlled current source in the form of a transistor Q4 is connected in series to the first current mirror path, and a resistance R4 is connected following the current source. A first current I1 through the first current mirror path is depending on a first driving signal Vb4 from current source transistor Q4, this driving signal being generated by a regulator 1 from a reference signal Vref and a signal Vm fed back from the output. A voltage divider R1, R2 is connected in parallel to the output terminals of the regulating system to generate feedback signal Vm dependent on output voltage Vout.

Regulator 1 has, for example, a proportional regulating response, and in the simplest case is in the form of a differential amplifier which provides driving signal Vb4 which is proportional to the difference between reference signal Vref and feedback signal Vm, this feedback signal Vm in the example shown being proportional to output voltage Vout. In order to reduce control deviations, regulator 1 may, of course, also have a proportional-integral response (PI regulator) or an integral response (I regulator).

The current mirror arrangement includes a second current mirror transistor Q3, the base of which is connected to the base of first current mirror transistor Q2, and the load path of which forms the second current mirror path. A second current I2 flows through the second current mirror path. In accordance with the current mirror relationship, this second current I2 is proportional to first current I1. In the embodiment shown, the area ratio between the emitter surface of first current mirror transistor Q2 and of second current mirror transistor Q3 is 1:M—so the applicable equation for second current I2 is:

$$I2=M\cdot I1 \quad (6)$$

In addition, the regulating system includes a splitter circuit or switch circuit (20) which conducts the second current I2 of the second current mirror path to output terminal K2 depending on the load path voltage Vec1 of regulating transistor Q1, or to a reference potential, in this case the reference potential GND of the circuit.

In the embodiment of FIG. 2, this splitter circuit 20 includes a diode D1 connected between the second current mirror path, i.e. the load path of second current mirror transistor Q3, and output terminal K2. In addition, splitter circuit 20 includes a semiconductor element in the form of pnp bipolar transistor Q5, the load path of which is connected between the second current mirror path and reference potential GND. The base terminal of this transistor Q5 is connected to the collector terminal of first current mirror transistor Q2 through bias source Vx. This bias source Vx serves to bias transistor Q5 which functions as a semiconductor switch, this bias Vx being chosen such that transistor Q5 takes over none of, or only a very small fraction of, second current I2 when diode D2 is conductive.

This bias source Vx, shown schematically in FIG. 2 as a voltage source, may be implemented, for example, as a diode (see FIG. 3), or also as an ohmic resistance.

Diode D1 is conductive when load path voltage Vec1 of regulating transistor Q1 becomes greater than threshold voltage Vth, for which the applicable equation is:

$$Vth=Vbe1+Vcesat3+Vd1 \quad (7)$$

where Vbe1 is the base-emitter voltage of regulating transistor Q1, Vecsat3 is the fabrication voltage of second current mirror transistor Q3, and Vd1 is the conducting-state voltage of diode D1. When diode D1 is conductive, regulating transistor Q1 and second current mirror transistor Q3, also in the form of a pnp bipolar transistor, form a Darlington configuration. The power loss of the regulating system in this operating state here is determined essentially by current I1 which does not contribute to output current Iout, while a larger component of regulating current Ib1 (for M>1) from regulating transistor Q1 is conducted to output K2 through the second current mirror path and diode D1.

Whenever load path voltage Vec1 falls below this threshold value Vth, then diode D1 is in the blocking state of diode D1, and second current I2 is conducted to reference potential GND through bipolar transistor Q5 of splitter circuit 20.

Independently of the switching state, one component of regulating current Ib1 is always formed by first current I1 in the first current mirror path, and a second, usually larger, component of regulating current Ib1 is formed by second current I2 in the second current mirror path in the regulating system shown. The applicable equation is always:

$$Ib1=I1+I2=(M+1)\cdot I1 \quad (8)$$

Because of splitter circuit 20, there is thus no increase in the current requirement of controlled current source Q4 when diode D1 is in the blocking state, and as a result, no abrupt rise in driving voltage Vb4 is required to drive transistor Q4, functioning in this example as the current source.

Figure 3:
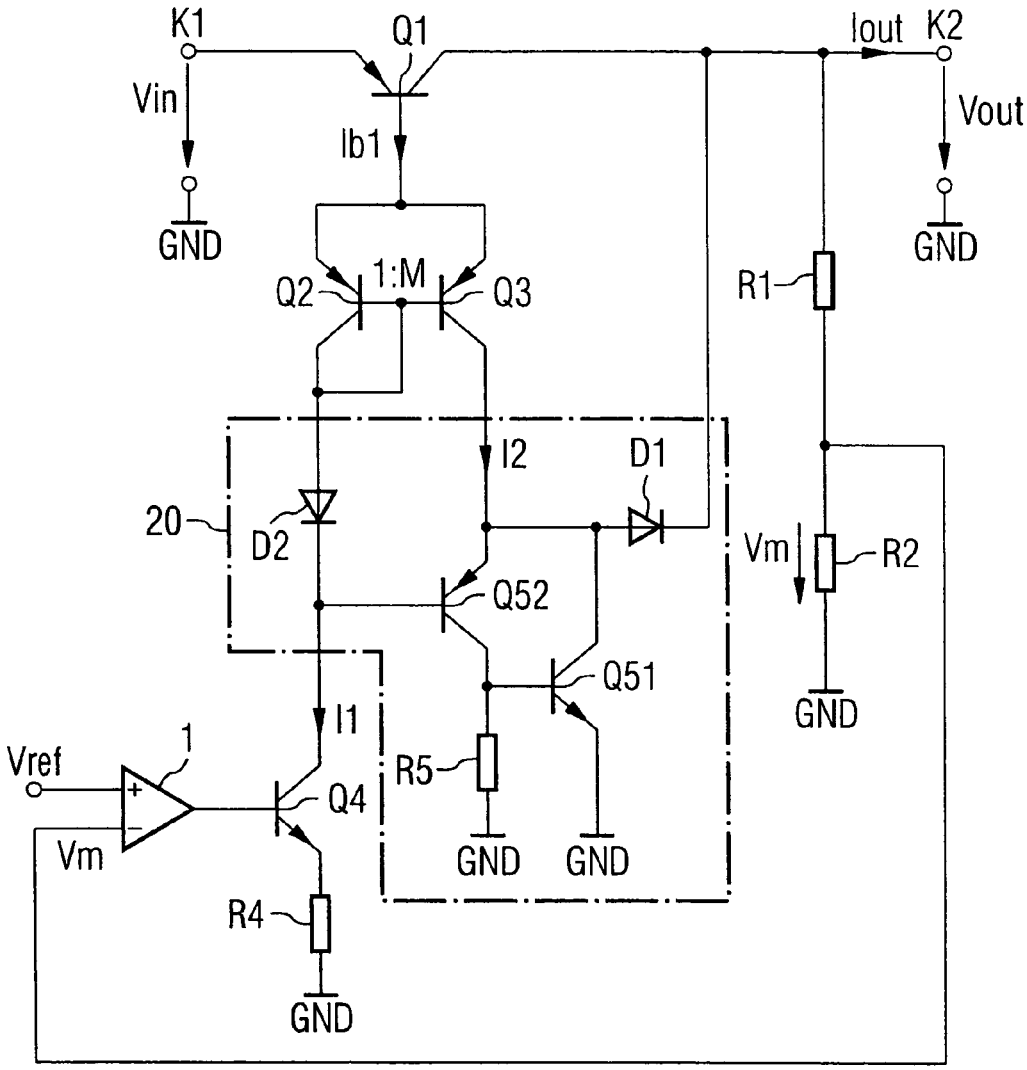
FIG. 3 shows a second embodiment of a regulating system according to the invention.

FIG. 3 shows the regulating system of FIG. 2 with a modified splitter circuit 20. In place of the single transistor Q5, this splitter circuit 20 includes two transistors Q51, Q52 connected in a Darlington configuration, in which the load path is connected in series to a resistance R5 between the second current mirror path and reference potential GND. The base of this bipolar transistor is coupled to the first current mirror path, wherein in FIG. 3 a diode D2 is employed as the bias source which is connected between the collector terminal of first current mirror transistor Q4 and the collector terminal of current source transistor Q4, the base terminal of bipolar transistor Q52 being connected to the junction of diode D2 and the collector terminal of current source transistor Q4. Diode D2 ensures that the base potential of bipolar transistor Q52 always remains below the value of the emitter potential of this transistor by an amount equal to the conducting-state voltage of diode D2, with the result that transistor Q52 is biased. If diode D1 is conductive, this bias is insufficient, however, to take over an essential fraction of second current I2.

An additional bipolar transistor Q51 is connected between the second current mirror path and reference potential GND, which transistor is in the form of a npn bipolar transistor, the base of which is connected to a junction of the load path of transistor Q52 and resistance R5.

Figure 4:
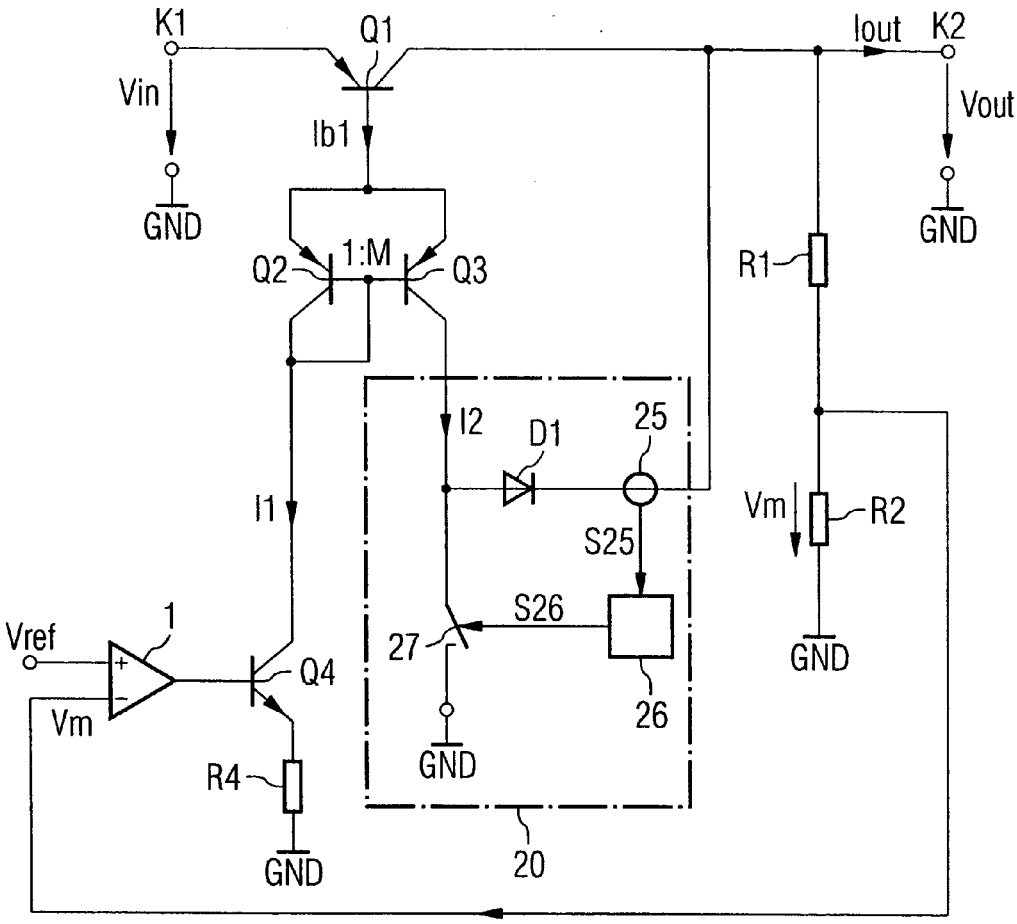
FIG. 4 shows another embodiment of a regulating system according to the invention.

FIG. 4 shows another embodiment of a splitter circuit 20. This splitter circuit includes a current measurement arrangement 25 which measures the current through diode D1, and which supplies a current measurement signal to a driving circuit 26 which serves to drive a switch 27 connected between the second current mirror path and the reference potential. If diode D1 is conductive in response to load path voltage Vec10 from regulating transistor Q1 that is above threshold voltage Vth, and if a current through diode D1 thus exceeds a predefined threshold value, then switch 27 is in the blocking state as controlled by driving circuit 26. If diode D1 is in the blocking state, and if the current through this diode thus falls below the predefined threshold value, then switch 27 is conductive, being controlled by driving circuit 26, so as to take over the second current I2 through the second current mirror path.

The regulating system shown in FIGS. 2 through 4 is in the form of a voltage regulator arrangement. Here a voltage signal Vm dependent on output voltage Vout is fed back to regulator 1 which provides a regulating current Ib1 for regulating transistor Q1 through controlled current source Q4 in connection with the current mirror. When output voltage Vout rises here, and when feedback signal Vm rises as a result above reference value Vref, transistor Q1 is deactivated. Conversely, the transistor is activated when the output voltage Vout falls.

The regulating system shown may, of course, also be employed as a current regulating system wherein in place of signal Vm dependent on output voltage Vout, a signal dependent on output current Iout is fed back to regulator 1. In this case, when output current Iout rises, regulating transistor Q1 is similarly deactivated, while transistor Q1 continues to be activated when output current Iout falls.

LIST OF REFERENCE NOTATIONS

D1 diode
D2 diode
GND10 reference potential
I1 first current
I2 second current
IB1 regulating signal, regulating current
Ib10 base current
IC30 collector current
IC40 collector current
Iout output current Iout10 output current
K1 input terminal
K10 input terminal
K2 output terminal
K20 output terminal
Q1 regulating transistor
Q10 regulating transistor, pnp bipolar transistor
Q2, Q3 current mirror transistors
Q20, Q30 current mirror transistors
Q4 current source, npn bipolar transistor
Q40 current source, npn bipolar transistor
Q5 npn bipolar transistor
Q51 npn bipolar transistor
Q52 pnp bipolar transistor
R1, R2 resistances
R10, R20 resistances
R40 resistance
R5 resistance
S25 current measurement signal
S26 driving signal
VB40 driving voltage
VBE40 base-emitter voltage
Vec10 load path voltage
Vin input voltage
Vin10 input voltage
Vm feedback voltage
VM10 feedback signal
Vout output voltage
Vout10 output voltage
Vref reference signal
Vref reference voltage
Vx bias source
Z10 load
1 regulator
10 regulator
25 current measurement arrangement
26 driving circuit
27 switch

What is claimed is:

1. A regulating system comprising:

an input terminal operable to receive an input voltage;

an output terminal operable to provide an output voltage and an output current;

a semiconductor element operable to regulate the output voltage, the semiconductor element including a load path connected between the input terminal and the output terminal, and a control input to which a regulating signal is applied;

a regulating signal generation circuit operable to generate the regulating signal, the regulating signal generation circuit having a current mirror arrangement including a first and second current mirror path, wherein a controlled current source is connected in series to the first current mirror path, the controlled current source operable to induce a first current dependent on one of the output voltage and output current in the first current mirror path, and wherein a second current through the second current mirror path is dependent on the first current; and a splitter circuit operable to conduct the second current to the output terminal or to a reference potential, dependent on a load path voltage applied over the load path of the semiconductor element.

2. The regulating system according to claim 1, wherein the splitter circuit conducts the second current to the output terminal when the load path voltage is greater than a predefined threshold value, and to the reference potential when the load path voltage is smaller than the threshold value.

3. The regulating system according to claim 1, wherein the splitter circuit comprises at least one rectifier element having a rectifier element load path connected between the second current mirror path of the current mirror arrangement and the output terminal, wherein the rectifier element is conductive when a predefined inception voltage is applied over the rectifier element load path; and a switching device including at least one switching element, wherein the switching device is connected between the second current mirror path and the reference potential, and wherein the switching device is designed to conduct the second current to the reference potential when the rectifier element is in a blocking state.

4. The regulating system according to claim 3, wherein the at least one switching element is a transistor including a transistor load path and a transistor driving terminal, wherein the transistor load path is connected between the second current mirror path and the reference potential, and wherein the transistor driving terminal is coupled to the first current mirror path.

5. The regulating system according to claim 3, wherein the switching device includes a first transistor and a second transistor, the first transistor including a first load path and a first driving terminal, and the second transistor including a second load path and a second driving element, wherein the first load path and the second load path are each connected between the second current mirror path and reference potential, wherein the first driving terminal is connected to the first current mirror branch, and wherein the second driving terminal is connected to a load path terminal of the first transistor.

6. The regulating system according to claim 3, wherein the switching device comprises a current measurement arrangement operable to measure a current through the rectifier element and to provide a current signal, and a driving circuit for the at least one switching element, wherein the current measurement signal is fed to the driving circuit and the driving circuit is operable to drive the switching element in a manner dependent on the current through the rectifier element.

7. The regulating system according to claim 1, wherein the regulating signal generation circuit includes a regulator, the regulator operable to receive a signal dependent on the output signal and a reference signal, and the regulator operable to provide a differential output signal which is fed to the controlled current source as an input signal.

8. The regulating system according to claim 7, wherein the controlled current source is a bipolar transistor, and the differential output signal is fed to the base of the bipolar transistor.

9. The regulating system according to claim 1, wherein the current mirror arrangement comprises:

a first current mirror transistor connected as a diode, the first current mirror transistor comprising a first current mirror transistor driving terminal and a first current mirror transistor load path, the first current mirror transistor load path forming the first current mirror path, and a second current mirror transistor, the second current mirror transistor comprising a second current mirror transistor driving terminal and a second current mirror transistor load path, wherein the second current mirror transistor driving terminal is connected to the first current mirror transistor driving terminal, and the second current mirror transistor load path forms the second current mirror path.

10. The regulating system according to claim 4, wherein the current mirror arrangement comprises:

a first current mirror transistor connected as a diode, the first current mirror transistor comprising a first current mirror transistor driving terminal and a first current mirror transistor load path, the first current mirror transistor load path forming the first current mirror path, and a second current mirror transistor, the second current mirror transistor comprising a second current mirror transistor driving terminal and a second current mirror transistor load path, wherein the second current mirror transistor driving terminal is connected to the first current mirror transistor driving terminal, and the second current mirror transistor load path forms the second current mirror path.

11. The regulating system according to claim 10, wherein the transistor driving terminal of the at least one switching element is coupled to a load path terminal of the first current mirror transistor.

12. The regulating system according to claim 11, wherein the transistor driving terminal of the at least one switching element is coupled to the load path terminal of the first current mirror transistor through a second rectifier element.

13. The regulating system according to claim 11, wherein the transistor driving terminal of the at least one switching element is coupled to the load path terminal of the first current mirror transistor through a resistance.

14. The regulating system according to claim 5, wherein the current mirror arrangement comprises:

a first current mirror transistor connected as a diode, the first current mirror transistor comprising a first current mirror transistor driving terminal and a first current mirror transistor load path, the first current mirror transistor load path forming the first current mirror path, and a second current mirror transistor, the second current mirror transistor comprising a second current mirror transistor driving terminal and a second current mirror transistor load path, wherein the second current mirror transistor driving terminal is connected to the first current mirror transistor driving terminal, and the second current mirror transistor load path forms the second current mirror path.

15. The regulating system according to claim 14, wherein the transistor driving terminal of the at least one switching element is coupled to a load path terminal of the first current mirror transistor.

16. The regulating system according to claim 14, wherein the transistor driving terminal of the at least one switching element is coupled to the load path terminal of the first current mirror transistor through a second rectifier element.

17. The regulating system according to claim 14, wherein the transistor driving terminal of the at least one switching element is coupled to the load path terminal of the first current mirror transistor through a resistance.

18. The regulating system according to claim 1, wherein the semiconductor element is a pnp bipolar transistor, and wherein the current mirror arrangement includes a plurality of pnp bipolar transistors.

19. The regulating system according to claim 3, wherein the at least one rectifier element rectifier element connected between the second current mirror branch and the output terminal is a diode.

20. The regulating system according to claim 7, further comprising a voltage divider coupled to the output terminal, wherein the voltage divider provides the signal dependent on the output signal.

* * * * *